US008607867B2

(12) United States Patent
Sarathi et al.

(10) Patent No.: US 8,607,867 B2
(45) Date of Patent: Dec. 17, 2013

(54) OIL RECOVERY PROCESS

(75) Inventors: Partha S. Sarathi, Bartlesville, OK (US); Riley B. Needham, Bartlesville, OK (US); Robert Scott Redman, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 348 days.

(21) Appl. No.: 12/907,776

(22) Filed: Oct. 19, 2010

(65) Prior Publication Data

US 2011/0094739 A1 Apr. 28, 2011

Related U.S. Application Data

(60) Provisional application No. 61/254,546, filed on Oct. 23, 2009.

(51) Int. Cl.
*E21B 43/24* (2006.01)

(52) U.S. Cl.
USPC ..... 166/272.3; 166/369

(58) Field of Classification Search
USPC ..... 166/268, 272.3, 303, 369
See application file for complete search history.

(56) References Cited

U.S. PATENT DOCUMENTS

| | | | | |
|---|---|---|---|---|
| 4,574,886 | A | 3/1986 | Hopkins et al. | |
| 4,598,770 | A * | 7/1986 | Shu et al. | 166/245 |
| 4,726,759 | A | 2/1988 | Wegener | |
| 5,052,482 | A | 10/1991 | Gondouin | |
| 5,055,030 | A | 10/1991 | Schirmer | |
| 5,339,897 | A | 8/1994 | Leaute | |
| 5,623,576 | A | 4/1997 | Deans | |
| 7,311,152 | B2 * | 12/2007 | Howard et al. | 166/372 |
| 7,464,756 | B2 * | 12/2008 | Gates et al. | 166/272.3 |
| 7,931,080 | B2 * | 4/2011 | O'Brien | 166/247 |
| 8,327,936 | B2 * | 12/2012 | Coskuner | 166/272.3 |
| 2006/0042794 | A1 | 3/2006 | Pfefferle | |
| 2006/0260814 | A1 | 11/2006 | Pfefferle | |
| 2008/0017372 | A1 * | 1/2008 | Gates et al. | 166/254.1 |
| 2008/0302523 | A1 * | 12/2008 | Wegener et al. | 166/63 |

* cited by examiner

*Primary Examiner* — Nicole Coy
(74) *Attorney, Agent, or Firm* — ConocoPhillips Company

(57) ABSTRACT

A method for recovering heavy oil in a stratum with an injection well, a production well and a steam generator. The method begins by injecting steam from the steam generator into a horizontal portion of the injection well followed by soaking the stratum with the steam from the injection well for a predetermined period of time; and producing heavy oil from the stratum with the production well.

5 Claims, 5 Drawing Sheets

OIL RECOVERY PROCESS

CROSS-REFERENCE TO RELATED APPLICATIONS

This application is a non-provisional application which claims benefit under 35 USC §119(e) to U.S. Provisional Application Ser. No. 61/254,546 filed Oct. 23, 2009, entitled "OIL RECOVERY PROCESS," which is incorporated herein in its entirety.

STATEMENT REGARDING FEDERALLY SPONSORED RESEARCH OR DEVELOPMENT

None

FIELD OF THE INVENTION

Method of recovering heavy oil with an injection well and a production well, wherein the depth of the production well is below the injection well.

BACKGROUND OF THE INVENTION

Steam Assisted Gravity Drainage (SAGD) and Cyclic Steam Stimulation (CSS), also referred to as the 'Huff and Puff' process, are the two most commonly used methods for recovering bitumen and heavy viscous oils from subterranean formations. In a SAGD method a pair horizontal wells serve both as an injector well and a production well. The injector well and the production well extend downwardly from the surface of the earth into the oil bearing stratum and then extend horizontally through the stratum. The horizontal portion of the production well is placed at the base of the oil bearing stratum and the horizontal leg of the injector well is placed at an optimal distance above and parallel to the production well. Steam is injected continuously into the stratum through the top well. Upon entering the stratum, the steam releases it latent heat to the stratum, thereby heating and lowering the viscosity in the formation and improving the mobility of the oil. The heated oil with condensed steam flows down under gravity toward the bottom production well from which it is produced.

Cyclic steam stimulation or the 'huff and puff' process is another commonly used method for recovering heavy viscous oils or bitumen from the subterranean formation. This process involves injecting a predetermined volume of steam into a stratum through a single vertical well for a selected duration, stopping the injection of steam, permitting the stratum to soak and followed by producing oil through the same well. Unfortunately, CSS has a number of limitations because it is a single well process and the recovery zone is limited to the near well bore region. Most notably, the ability to improve recovery requires CSS to drill a large number of wells.

There are a variety of problems associated with the 'SAGD' and the 'Huff and Puff' processes. A commonly used criterion to establish the efficiency of a steam based oil recovery process is the steam oil ratio (SOR). SOR is the measure of barrels of steam needed to produce one barrel of oil. Both thermal and recovery efficiency (and by implication the economics) of the process is a function of SOR. A smaller SOR implies higher thermal efficiency and better economics. Both SAGD and CSS are thermally inefficient. A major drawback of the SAGD processes is that it requires large volumes of high quality (90-100% quality) steam to heat the reservoir and recover oil at economic rate. In thick, high quality reservoir the SAGD recovery can exceed 50% of oil from the steam contacted region at a SOR greater than 3.0, but in thinner reservoir with lower oil saturations, SORs are much higher.

Also SAGD oil recovery depends only on the available latent heat content of the steam (sensible heat has no value to the recovery process). Since the latent heat content of the steam decreases with increase in steam pressure the SGAD process becomes uneconomic if implemented at greater depth (reservoir pressure and consequently the steam injection pressure increases with depth). The use of surface generated steam as the heat source also limits the depth at which the process can be implemented due to conductive heat losses (degradation of steam quality) through the well bore.

Irrespective of reservoir quality, steam quality and oil saturation, CSS recovery method seldom exceeds 20% oil in place at SORs in excess of 5. Use of lower quality steam in the CSS process in reservoirs containing highly viscous oil is less effective in lowering the viscosity of the oil, limit the radius of invasion of the steam, lower the reservoir sweep and result in lower recovery due to slower rate of flow of higher viscosity oil during the production cycle. In CSS processes high heat efficiency would be promoted by lower pressure and high quality steam. Thus processes that promote high recovery of viscous oil at lower SOR are needed. Conventional steam injection processes such as SAGD and CSS produce SOR in the excess of 3.0.

There exists a need to provide an improved viscous oil recovery process that overcome the limitations of SAGD and the CSS process to provide profitable recovery of heavy oil/bitumen from thinner formations than currently permitted with conventional steam heating processes.

SUMMARY OF THE INVENTION

A method for recovering heavy oil in a stratum with an injection well, a production well and a steam generator. The method begins by injecting steam from the steam generator into a horizontal portion of the injection well followed by soaking the stratum with the steam from the injection well for a predetermined period of time followed by producing heavy oil from the stratum with the production well. In the method the depth of a horizontal portion of the production well is below the horizontal portion of the injection well and the position of the steam generator is placed along the horizontal portion of the injection well.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Figure 1:
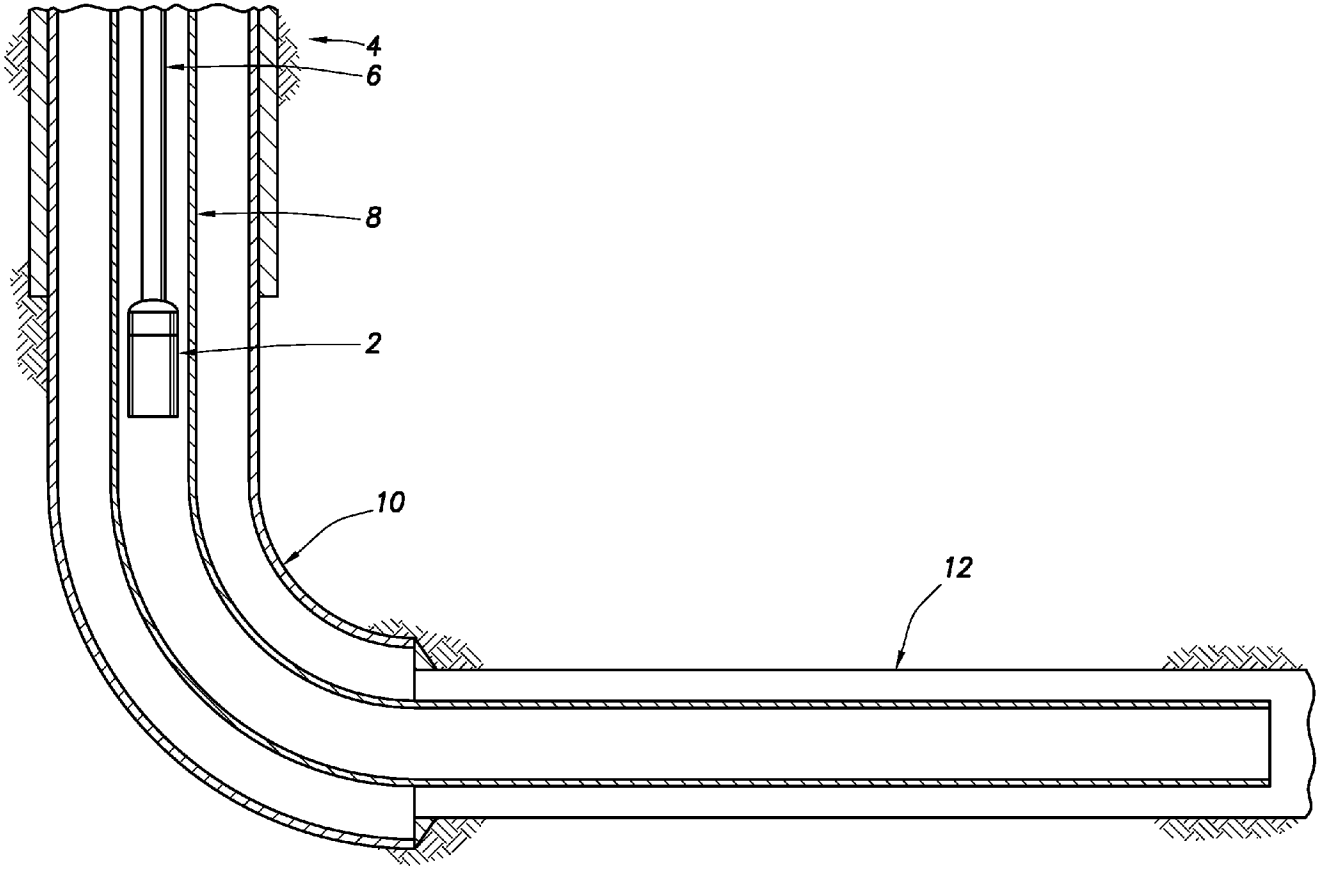
FIG. 1 depicts a steam generator placed downhole in the injection well.

The present method of recovering heavy oil with an injection well and a production well through the use of steam generation. Recovery of the heavy oil or bitumen is accomplished by using steam generators placed downhole along the horizontal portion of the injection well. The orientation of the wells is placed so that the injection well is located above the production well, wherein the production well is utilized to produce heated oil. The pair of wells is oriented to take advantage of gravity segregation of the steam and the oil to decrease the production of hot water or steam and thereby increase the thermal efficiency as expressed as a steam to oil ratio.

Steam is generated in the steam generator located at the horizontal portion of the injector well, wherein the horizontal portion of the injector well extend from the bottom portion of the vertical portion of the injector well to the far end of the horizontal section of the injector well. Placement of the steam generator along the horizontal portion results in higher quality steam, nearing 100% quality steam, to be present downhole.

Criteria for the volume of steam to be injected per cycle, injected steam quality, injection duration, soak time and production duration have been established in the art. Generally the production cycle is of much longer duration compared to the injection cycle or soaks time. In bitumen reservoirs or in reservoirs where the oil is practically immobile, the injection and the production well vicinity is heated by circulating steam through the casing—tubing annulus or by other means to decrease the near well bore resistance, to facilitate injection of adequate volume of steam to lower bitumen viscosity and to establish communication between injector and the producer.

Steam and combustion gases are injected into the injection well in a predetermined sequence from a steam generator housed in the injection well. The injected steam-combustion gas is allowed to soak for a brief period, from about 1-10 days, about 2-8 days or 3-6 days, to transfer the heat, reduce the viscosity of the oil and to facilitate the dissolution of a small fraction of the combustion gas into the heated oil. The heated oil and the condensed steam are then allowed to drain by gravity toward the production well. The well is then put on production for an extended duration, from about 7-20 months, about 9-18 months or about 11-16 months or until such time the oil recovery falls below the cut-off value.

A low steam to oil mixture reduces the volume of steam injection per cycle. Further the presence of non-condensable gases in the vapor phase of the steam reduces the partial pressure of the steam in the vapor phase. This causes the liquid phase water to vaporize and increase the steam quality. High quality steam is a combination of low levels of liquid water and high temperature. High quality steam generally has a temperature higher than 100° C.

If the injected steam is of sufficiently high quality any addition of non-condensable gas to the vapor phase likely to cause the steam to become saturated or superheated. This can results in two beneficial effects: (1) increased steam volume resulting from a lowering of the steam partial pressure and temperature leads to improved reservoir conformance and (2) reduced heat loss and recovery of lost heat from the surrounding area as a result of the lowering of saturated steam temperature. This results in better utilization of the same amount of injected heat (improved thermal efficiency). The two phase steam/gas mixture is less prone to phase separation, results in more uniform steam quality, enhances its ability to heat the wellbore region by thermal conduction and promotes more uniform drainage of the heated oil.

Further the injection of the combustion gases with steam results in upward movement of gas to the formation above the injection well. As a result the pressure at the top of the reservoir is increased and provides a potential gradient that augment gravity and accelerate the downward movement of the heated oil toward the production well. As the oil drains downward, the raising gas fills the space of the vacated oil and accumulates at the top. As a result, a thin layer of gas accumulates at the top of the reservoir and tended to spread laterally along the top of the reservoir as the process continues. The accumulated gas acts as an insulator and reduces the heat loss to the overburden. Also the counter-current flow of the rising gas to falling liquid increase the contact area for mass transfer and cause the steam to spread aerially and improve the reservoir sweep. Lower heat losses result in significant oil viscosity reduction and more mobile oil. Thus lower steam requirement, better heat utilization, and more mobile oil together the use of added soak time and longer production duration allow gravity drainage as the dominant oil recovery mechanism contribute to very high oil recovery and significant reduction in steam to oil ratio. The current method is able to produce steam oil ratios between 0.1 to 1.2, in a preferred embodiment the current method produces steam oil ratios between 0.2 to 0.8.

TABLE 1

Summary of DownHole Steam Generation (DHSG) versus Surface Steam Generation (SSG)

| | 1 | 2 |
|---|---|---|
| Steam Source | SSG | DHSG |
| Steam Quality (Steam oil ratio) | 0.9 | 0.9 |
| Cumulative Recovery Millions Barrels | 2.2 | 2.4 |
| Oil Recovery as % Original Oil in Place | 44.6 | 48.6 |

Table 1 summarizes selected SAGD runs conducted to investigate the effect of reservoir and operation parameters on the process performance. The table demonstrates that even though run 1 (performed with SSG) outputs similar steam quality as run 2 (performed with DHSG), the amount of steam recovered is significantly lower. This is due to the loss of steam quality as it traverses the well towards the stratum. By placing a steam generator downhole higher quality steam can penetrate the stratum

TABLE 2

Summary of steam quality in relation to oil recovery

| | 1 | 2 | 3 |
|---|---|---|---|
| Steam Source | DHSG | DHSG | DHSG |
| Steam Quality (Steam oil ratio) | 0.9 | 0.7 | 0.5 |
| Cumulative Recovery Millions Barrels | 2.2 | 1.7 | 1.4 |
| Oil Recovery as % Original Oil in Place | 44.6 | 34.5 | 28.4 |
| % Heat Returned to Surface from Injection | 37.2 | 49 | 55 |

Table 2 summarizes that oil recovery and the thermal efficiency of the SAGD process as measured by the cumulative steam oil ratio are sensitive to steam quality. A negative variation of steam quality lowers the cumulative recovery of oil and increases the percent of heat that is returned to the surface. This is because lower quality steam contains less latent heat than high quality steam. Since a typical SAGD oil recovery depends only on the available latent heat the recovery reflects the influence of the injected steam quality.

TABLE 3

Summary of DownHole Steam Generation (DHSG) versus Surface Steam Generation (SSG) Cyclic Steam Stimulation (CSS) performance between a single well and two wells

| | SSG - One Well | SSG - Two Wells | DHSG - One Well | DHSG - Two Wells |
|---|---|---|---|---|
| Steam Quality | 0.9 | 0.9 | 0.9 | 0.9 |
| Primary Recovery in millions of barrels | 0.07 | 0.07 | 0.07 | 0.07 |
| Primary Recovery as % Original Oil in Place | 1.34 | 1.34 | 1.34 | 1.34 |
| 15 Year Recovery in millions of barrels | 2.0 | 2.9 | 2.06 | 2.93 |
| 15 Year Recovery as % Original Oil in Place | 40 | 57 | 40 | 58 |
| Cumulative Steam Oil Ratio | 0.7 | 0.5 | 0.6 | 0.4 |
| % Heat Returned to Surface from Injection | 51.6 | 24.3 | 50.8 | 24.1 |

Table 3 summarizes the both the improvement of utilizing two wells for a CSS performance and the benefits of using a down hole steam generator. Table 3 also shows how although primary recovery is identical for the SSG one well and two wells as compared to DHSG one well and two wells. The difference is shown during the long term recovery of the oil wherein an increase in the amount of oil recovered is shown. Additionally lower cumulative steam oil ratio's and lower % heat returned to surface can be shown from this table.

FIG. 1 depicts a steam generator placed downhole in the injection well. In this figure the downhole steam generator 2 is placed in the tubing 8 of the vertical section of the injection well 4. A typical three coil tubing bundle 6 is used to provide the air, water and natural gas needed to the downhole steam generator 2. Steam generated from the downhole steam generator 2 is flowed towards the horizontal portion of the injection well 12 by travelling along the vertical section of the injection well 4.

Figure 2:
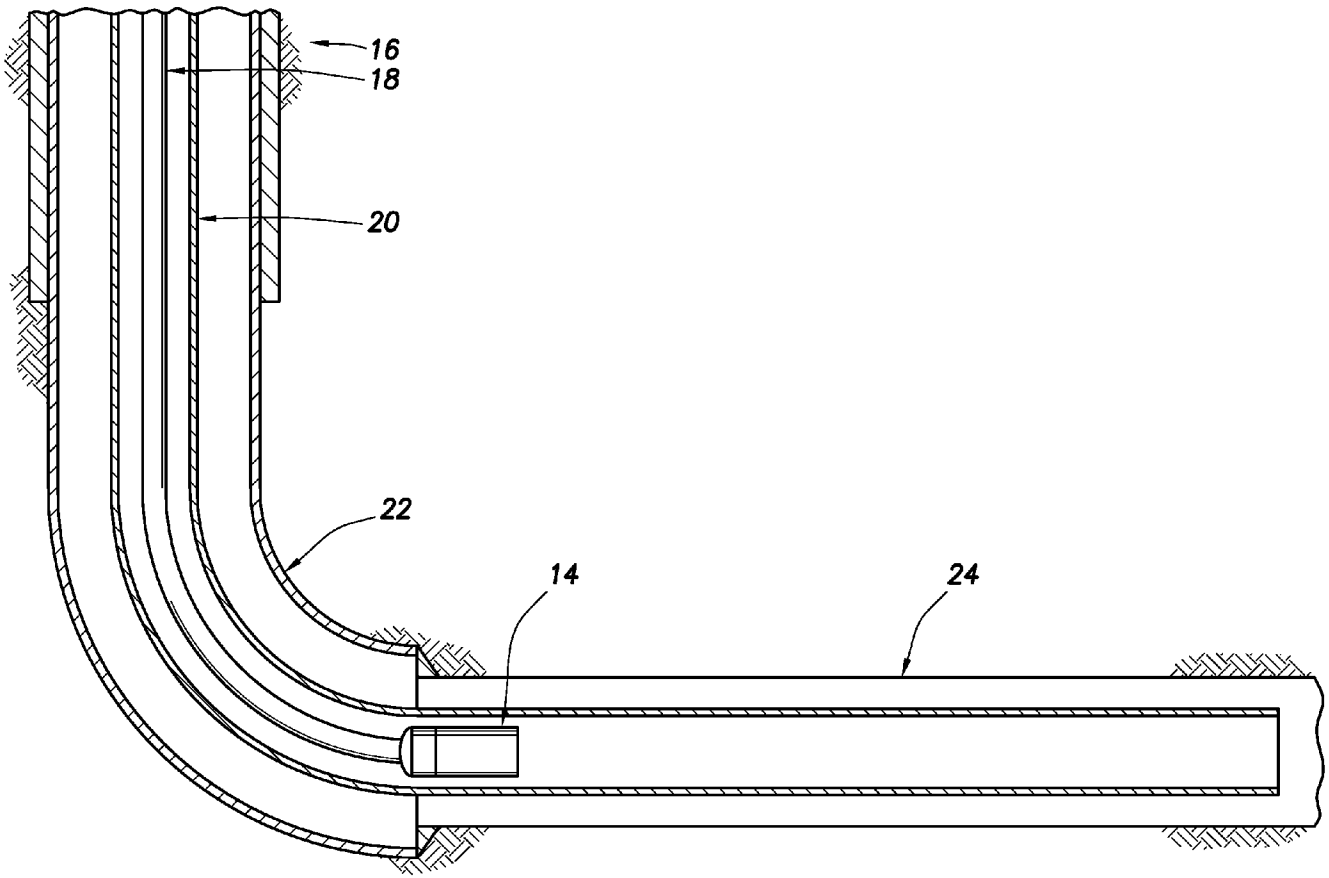
FIG. 2 depicts a steam generator placed along the horizontal portion of the injection well.

FIG. 2 depicts a steam generator placed along the horizontal portion of the injection well. In this figure the downhole steam generator 14 is placed in the tubing 20 of the horizontal portion of the injection well 24. A typical three coil tubing bundle 18 is used to provide the air, water and natural gas needed to operate the downhole steam generator 14. In this depiction, the steam generated from the downhole steam generator 14 does not have to flow through the vertical section of the injection well 16 and instead directly injected into the horizontal portion of the injection well 24.

Figure 3:
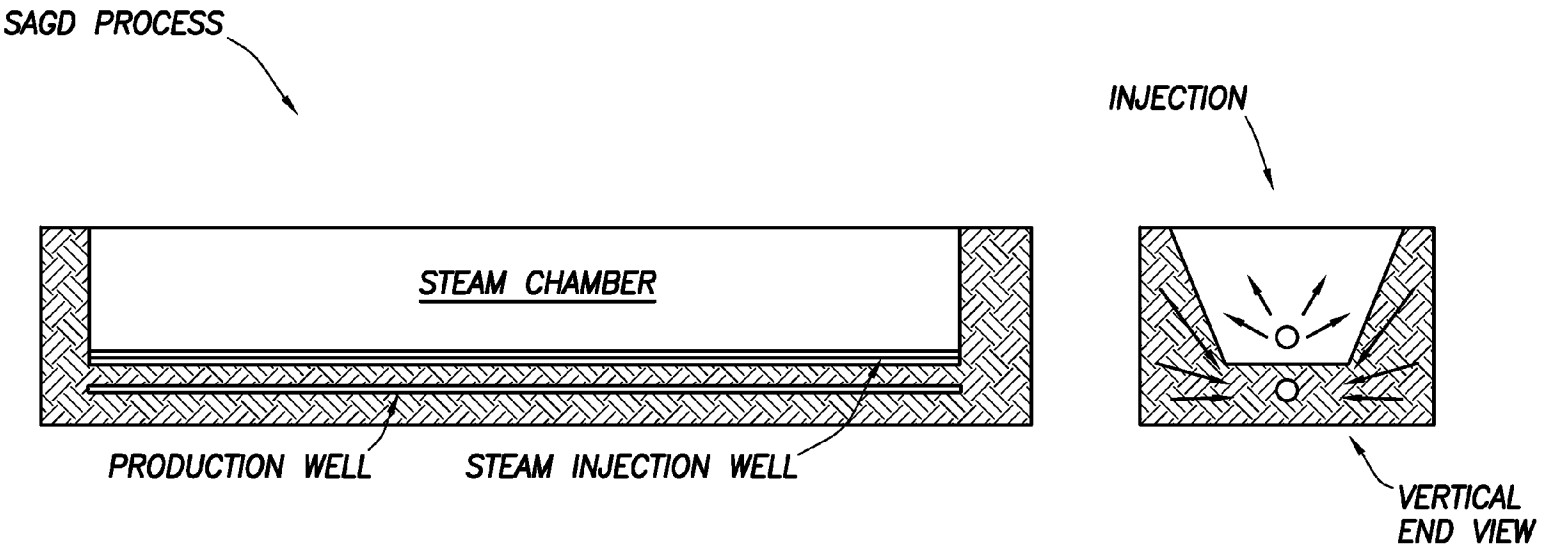
FIG.3 PRIOR ART
FIG. 3 depicts a typical SAGD oil recovery process.

FIG. 3 depicts a typical SAGD process. In the SAGD process, two parallel horizontal oil wells are drilled in the formation, one about 4 to 6 meters above the other. The upper well injects steam, possibly mixed with solvents, and the lower one collects the heated crude oil or bitumen that flows out of the formation, along with any water from the condensation of injected steam. The basis of the process is that the injected steam forms a "steam chamber" that grows vertically and horizontally in the formation. The heat from the steam reduces the viscosity of the heavy crude oil or bitumen which allows it to flow down into the lower wellbore. The steam and gases rise because of their low density compared to the heavy crude oil below, ensuring that steam is not produced at the lower production well. The gases released, which include methane, carbon dioxide, and usually some hydrogen sulfide, tend to rise in the steam chamber, filling the void space left by the oil and, to a certain extent, forming an insulating heat blanket above the steam. Oil and water flow is by a countercurrent, gravity driven drainage into the lower well bore. The condensed water and crude oil or bitumen is recovered to the surface by pumps such as progressive cavity pumps that work well for moving high-viscosity fluids with suspended solids.

Figure 4:
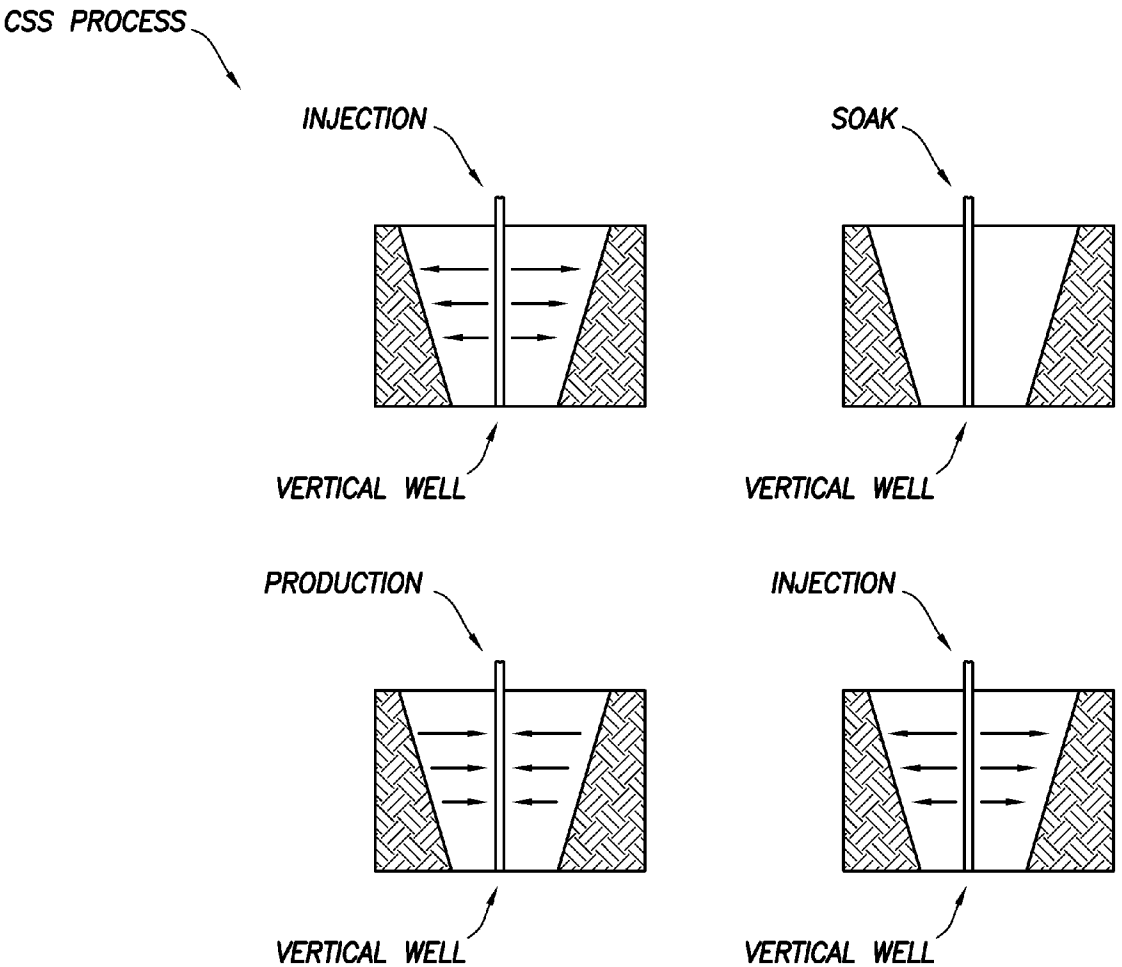
FIG. 4 PRIOR ART
FIG. 4 depicts a typical CSS oil recovery process.

FIG. 4 depicts a typical CSS process. CSS consists of a single vertical well performing three main steps: injection, soaking and production. Steam is first injected into a well for a certain amount of time to heat the oil in the surrounding reservoir to a temperature at which it flows. After it is decided enough steam has been injected, the steam is usually left to "soak" for some time after (typically not more than a few days). Then oil is produced out of the same well, at first by natural flow (since the steam injection will have increased the reservoir pressure) and then by artificial lift. Production will decrease as the oil cools down, and once production reaches an economically determined level the steps are repeated again. This process can be quite effective, especially in the first few cycles. However, it is typically only able to recover approximately 20% of the original oil in place.

Figure 5:
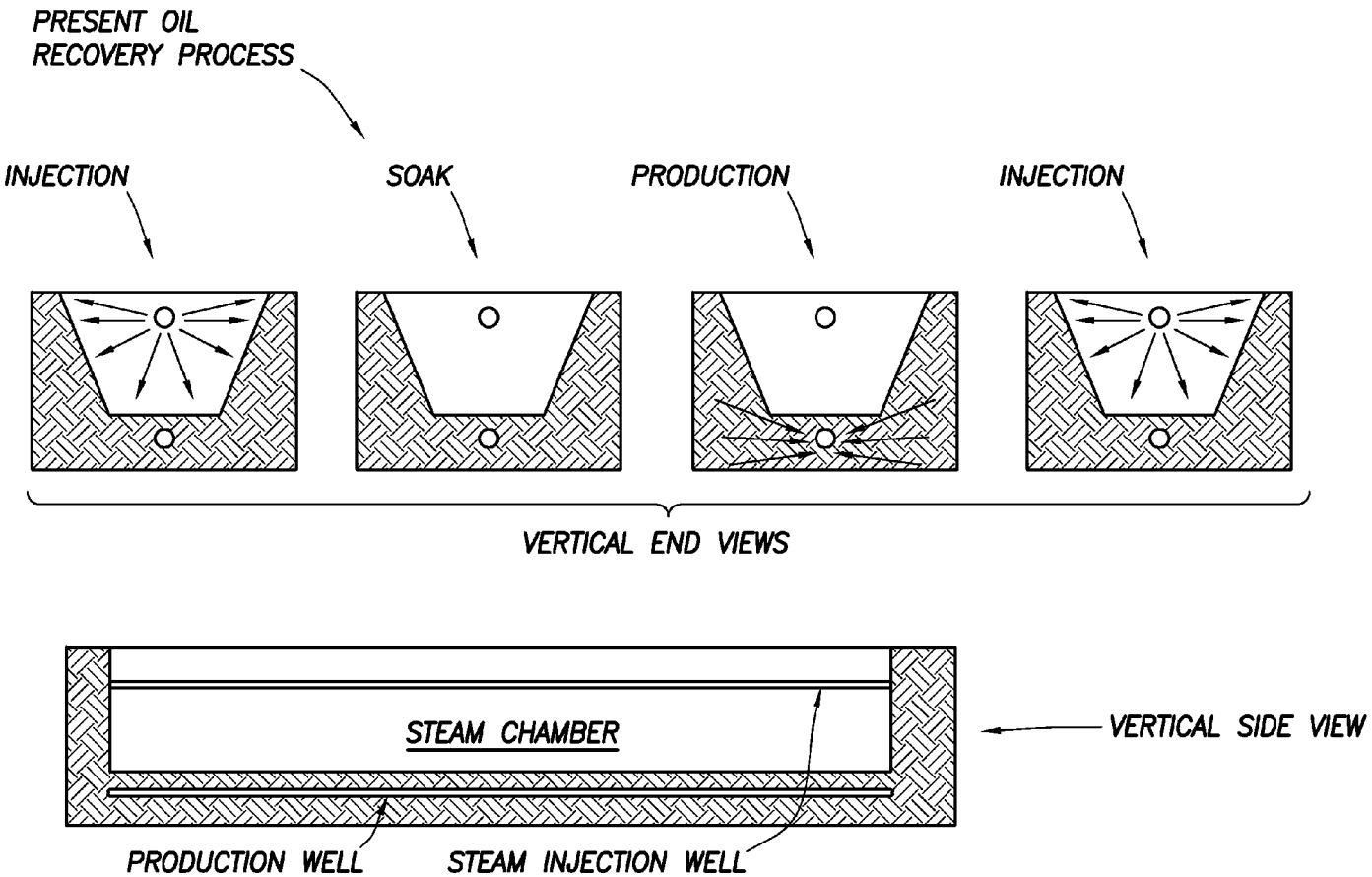
FIG. 5 depicts one embodiment of the present oil recovery process.

FIG. 5 depicts the present oil recovery process. This process utilizes two parallel horizontal wells similar to SAGD, combined with the three main steps of CSS: injection, soaking and production while further improving typical SAGD and CSS production by placing the steam generator in the horizontal portion of the injection well. The method begins by injecting steam from a steam generator into a horizontal portion of an injection well. The stratum is then soaked with the steam from the injection well for a predetermined period of time. Heavy oil is then produced from the stratum with a production well. In this depiction the depth of a horizontal portion of the production well is below the horizontal portion of the injection well and the position of the steam generator is placed along the horizontal portion of the injection well.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

a) injecting steam from a steam generator into a horizontal portion of an injection well;

b) soaking a stratum with the steam from the injection well for a predetermined period of time; and c) producing heavy oil from the stratum with a production well between multiple cycles of the injecting steam and soaking the stratum, wherein the depth of a horizontal portion of the production well is below the horizontal portion of the injection well such that the injecting and the soaking results in draining the heavy oil produced with the production well and the position of the steam generator is placed along the horizontal portion of the injection well.

2. The method of claim 1, wherein oil is produced with a cumulative steam oil ratio from 0.1 to 1.2.

3. The method of claim 1, wherein oil is produced with a soak time is less than 7 days.

4. The method of claim 1, wherein the quality of steam injected into the stratum is greater than 85%.

5. The method of claim 1, wherein the percentage of heat returned to the surface from the steam generator is less than 25%.

* * * * *